US005407299A

United States Patent [19]

Sutton

[11] Patent Number: 5,407,299

[45] Date of Patent: Apr. 18, 1995

[54] CEMENT SLURRY MIXING APPARATUS AND METHOD OF USING CEMENT SLURRY

[76] Inventor: John S. Sutton, P.O. Box 677, Keller, Tex. 76248

[21] Appl. No.: 5,667

[22] Filed: Jan. 19, 1993

[51] Int. Cl.[6] ..... E01C 7/14

[52] U.S. Cl. ..... 404/75; 404/108; 366/2

[58] Field of Search ..... 404/72, 75, 82, 108, 404/101, 105, 110, 111, 115; 366/2

[56] References Cited

U.S. PATENT DOCUMENTS

| | | | |
|---|---|---|---|
| 2,758,945 | 8/1956 | Widmayer | 117/104 |
| 3,053,673 | 9/1962 | Walker | 106/90 |
| 4,074,802 | 2/1978 | Hudis | 404/101 X |
| 4,106,111 | 8/1978 | Rose | 366/3 |
| 4,210,455 | 7/1980 | Metcalf et al. | 106/90 |
| 4,264,212 | 4/1981 | Tookey | 366/3 |
| 4,311,274 | 1/1982 | Neal | 239/1 |
| 4,863,277 | 9/1989 | Neal | 366/137 |
| 4,870,120 | 9/1989 | Tsubakimoto et al. | 524/5 |
| 5,046,855 | 9/1991 | Allen et al. | 366/137 |
| 5,064,292 | 11/1991 | Sutton | 366/2 |
| 5,069,578 | 12/1991 | Bense et al. | 404/75 |
| 5,103,908 | 4/1992 | Allen | 166/285 |

OTHER PUBLICATIONS

Paving Progress Publication, No. 28, Published by Portland Cement Association, Chicago, Ill., 1960, p. 2, "Mississippi Stabilizes U.S. 49 Shoulders with S/C".

*Primary Examiner*—Ramon S. Britts
*Assistant Examiner*—James A. Lisehora
*Attorney, Agent, or Firm*—T. D. Copeland

[57] ABSTRACT

This invention discloses a high rate, cement slurry mixing system and method which produces a highly dispersed slurry with the lowest possible viscosity in respect to the water cement ratio and the type and amount of chemical dispersant used in the slurry formulation. The slurry so produced is used in soil-cement construction operations and has the advantage of delayed hydration to allow reasonable time for slurry transport, spreading, intermixing with the soil, plus time for grading, shaping and compaction before a significant amount of cement hydration (setting) occurs.

1 Claim, 4 Drawing Sheets

CEMENT SLURRY MIXING APPARATUS AND METHOD OF USING CEMENT SLURRY

BACKGROUND OF INVENTION

1. Field of Use

The invention will be used in the construction industry for preparing in-place soil-cement or for mixing haul-in soil-cement commonly used for the base layer under Portland cement concrete or asphalt concrete roads, parking lots, runways, taxi ways, aporns and the like; and in the construction of land fill containment bases and dikes. Soil-cement in this definition includes in-place native soil, natural aggregate such as gravel, processed aggregate such as washed sand, and waste or reclaimed material such as reground asphalt road bed. The process of incorporating cement into road base material is commonly known as Cement Treated Base or "CTB" operations.

2. Prior Art

Construction methods for preparing a base for a road bed or the like before CTB operations commence, vary considerably with intended use, strength requirements, and whether new construction or rehabilitation of an old road. CTB operations start when the base material (native soil, subsoil, plus any haul-in aggregates and/or reclaimed material) are placed to specified depth and grade. A current method employed by road builders commonly includes:

a. Spreading dry cement in a uniform layer on top of the base material.

b. Mixing the dry cement into the base material on the top part of the base material.

c. Adding extra water as needed to bring the total moisture of the CTB layer to optimum percentage needed for maximum density compaction.

d. Mixing the total CTB layer to provide uniform cement and moisture throughout.

e. Shaping, grading and compaction to approximate grade.

f. Finishing to final base grade and plan.

g. Keeping the surface of the CTB damp until covered by a cure coat of asphalt or other material.

After a curing period of one to fourteen days, the CTB surface is then covered with the final layer of concrete or asphalt concrete.

Portland cement owes most of its strength producing properties to chemical hydration, a process where liquid water combines with the cement particles to form crystalline water. Thus, most efficient use of the cement (of highest strength) in respect to the amount of cement used is attained when mixing, shaping, grading and compaction are complete before a significant amount of chemical hydration of the cement occurs. Gypsum is interground with cement clinker to provide a basic hydration delay of ½ to 2 hours for Portland cement, depending on the ambient temperature. However, to fully activate the retardation provided by the gypsum, a continuous water phase must be present. Cement clinker, without the retardation influence of gypsum, hydrates in less than 15 minutes. Since moisture is in the base material and the temperature of the base material is influenced by weather conditions, large variations in the strength produced can occur when using dry cement addition. The lack of sufficient time to complete compaction and finishing of the CTB and the absence of any convenient means to delay the hydration time are inherent deficiencies of using dry cement in CTB operations.

Cement dust generated by spreading and mixing dry cement into base material is always hazardous to some extent to the area surrounding a CTB construction site. The fine, highly alkaline silicate particles can damage delicate vegetation, painted surfaces, and is hazardous to skin, lungs, and eyes of humans and animals. Cement dust is especially objectionable in heavily populated areas and areas of high vehicle traffic.

Using cement slurry prepared by a method which eliminates cement dust at the construction site is a direct solution to aforementioned deficiencies prevalent when using dry cement spreading. Such a method was shown in U.S. Pat. No. 5,064,292 issued to John S. Sutton, Nov. 12, 1991. The method shown therein produced a slurry ideally suited for CTB construction. However, that method, required off-site mixing to eliminate the cement dust, required batch weighing equipment, transportation time from batch plant to construction site, and the mixing trucks used were excessively heavy with poor maneuverability for spreading the slurry. The mix rate per unit was too slow for many large scale CTB operations requiring several units to keep pace.

Further, the additional retarder required for locations more than 60 minutes from the batch plant can easily result in slow strength development which can delay placement of the surface course of concrete or asphalt material. Still further slurry mixing rate and changes were at the mercy of other demands on the batch plant.

U.S. Pat. No. 5,064,292, is incorporated herein by reference.

SUMMARY OF INVENTION

The present invention is an improvement to that shown in the applicant's previous U.S. Pat. No. 5,064,292. The present invention provides an on-site dust-free mixing method which is capable of mixing cement slurry suitable for CTB construction at rates exceeding 100 tons of cement per hour with a single on-site mixing unit. It enables the use of smaller, lighter and more maneuverable spreader trucks and for alternate spread methods which eliminate much of the slurry transportation time and facilitate on-site adjustment and control of slurry properties and slurry production.

The problems of conventional CTB construction methods using dry cement spreading are resolved by preparing a suitable water-cement slurry using a portable mixing system which is placed at the construction site and is capable of mixing dry cement directly from cement transport truck using a pneumatic delivery system and at overall average rates exceeding 100 tons/hr., if needed. The mixing system consists of a horizontal tank of sufficient volume to hold cement slurry resulting from mixing 25 tons of dry cement (a typical truck load). The tank is equipped with a horizontal paddle which has a clearance to the bottom of the tank sufficiently small as to prevent settling of cement particles during mixing operations. The mixing system is equipped with a pump or pumps which withdraw fluid from the tank and pump it through a fluid-dry powder mixing eductor which exits back into the tank. The dry cement source is connected to the suction of the mixing eductor and is pulled into the eductor by a ventura effect produced by the tank fluid or a combination of tank fluid and water being pumped through the mixing eductor.

A principal object of this invention is to provide a means and a method of constructing cement-treated base for building concrete and asphalt concrete highways and the like, as explained above, but where the customary dry cement spreading is replaced by cement slurry produced by the mixing system of this invention.

An additional objective of the mixing system of this invention is to provide a means of using available ligno sulfonate (or organic acid derivative-ligno sulfonate blend) water dispensing-chemical-hydration retarder, at a controlled dosage, and using such dispersing retarders to extend available time to complete the CTB construction before significant cement hydration occurs.

A further object of the mixing system of this invention is to accomplish high shear rate, high energy rate mixing of the slurry by circulating the mixed or partly mixed slurry in the tank through mixing jet(s) or nozzle(s) located in the mixing eductor or mixing eductor discharge line.

A still further object of the mixing system of this invention is to produce a water-cement slurry which is free of lumps or nodules of undispersed cement, is free flowing, is relatively thin for the percent solids carried in the slurry, and does not settle excessively. With these properties the typical water spray truck can be used for spreading (or spraying) the slurry with minimum modification.

BRIEF DESCRIPTION OF THE DRAWINGS

FIG. 1 shows the left part with the air separator, mixing eductor and containment tank with part of the tank with a section removed to show the slow speed paddle. FIG. 2 shows the right part with circulation pump and water pump.

DESCRIPTION OF PREFERRED EMBODIMENT(S)

Figure 1:
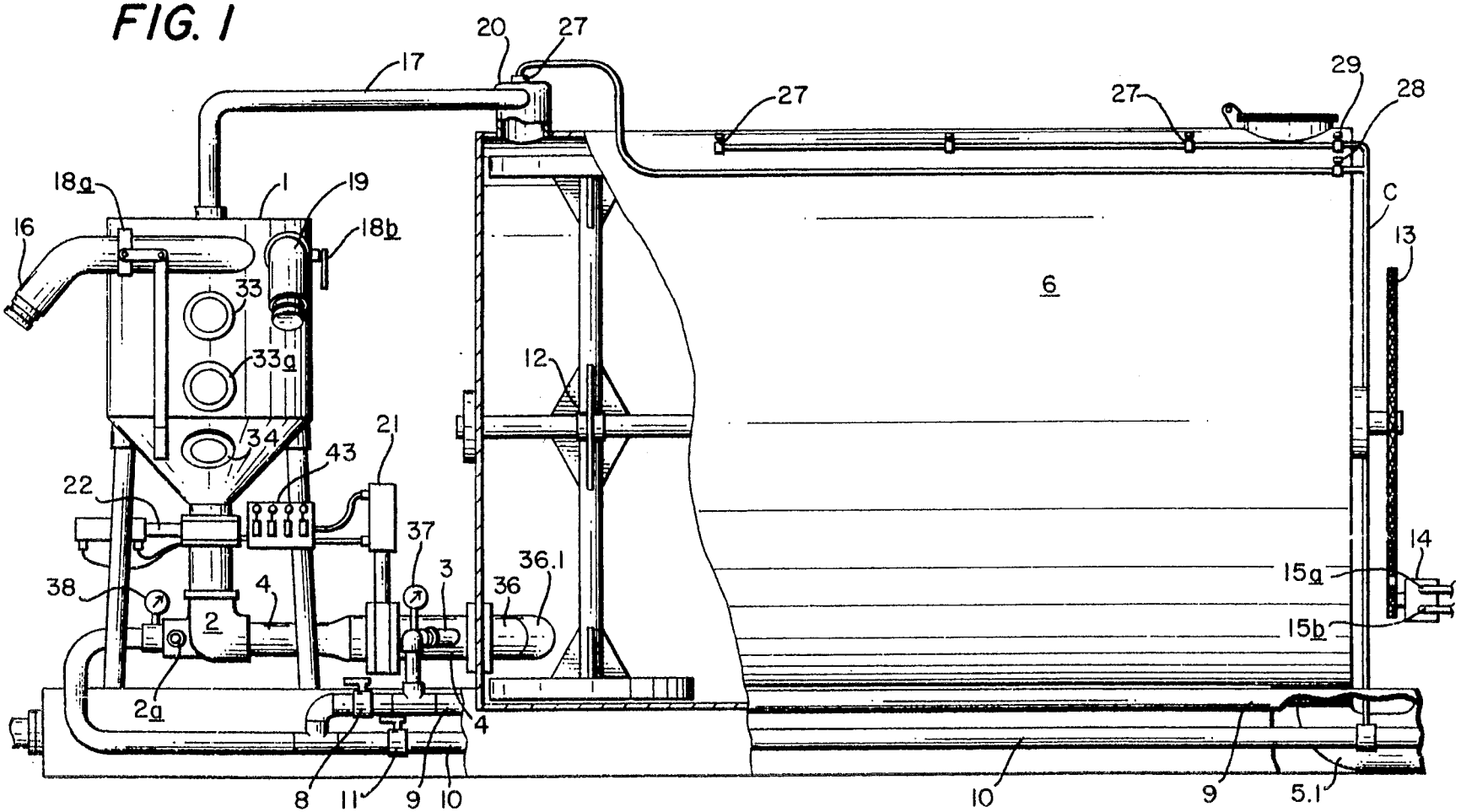
FIGS. 1 and 2 combined show a view of a typical two-pump mixing system and batch containment tank.
Figure 3:
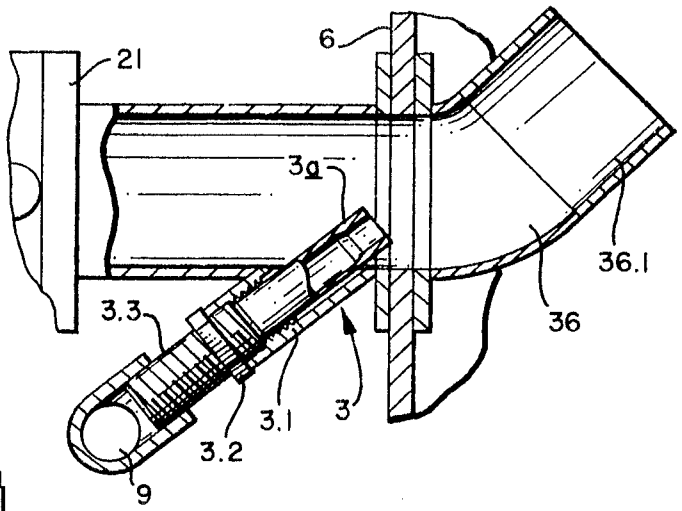
FIG. 3 shows detail in section of the tank fluid recirculation jet and its placement in the eductor discharge line.
Figure 2:
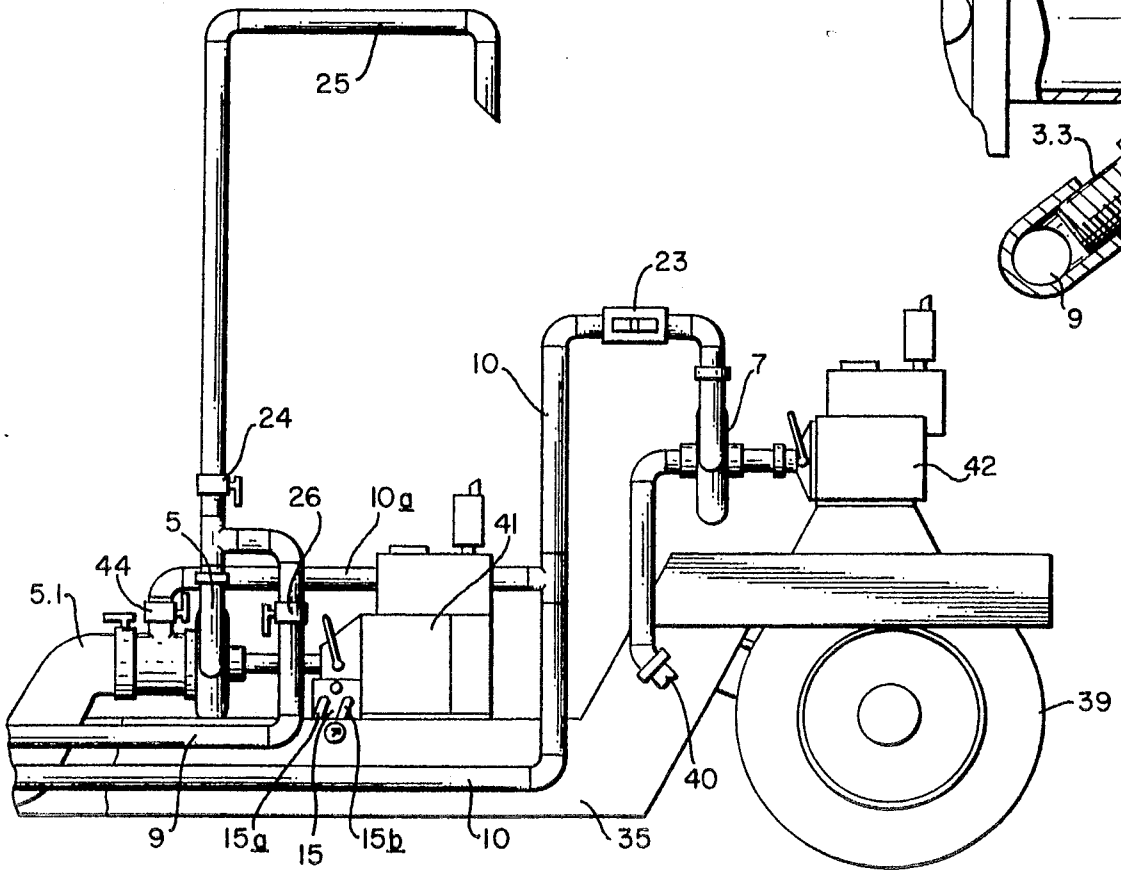

There are a number of possible combinations of pumps and jet placements which can be used with this invention. FIGS. 1 and 2 combined is a view of a typical two-pump system using a cyclone separator 1 to separate the carrier air from the dry cement flow, a selective orifice (jet nozzle) dry cement mixing eductor 2, a tank fluid recirculation jet 3, placed in the eductor discharge line 4 just before entering tank 6. Tank fluid is circulated by pump 5 which withdraws fluid from tank 6 via suction line 5.1 and pumps through bypass jet 3. Primary motive mixing fluid for the mixing eductor 2 is water pumped by pump 7 via line 10 through eductor 2 mixing jet. Valve 8 is placed between the recirculation line 9 and the water line 10 to provide a means for alternantly using tank fluid for the mixing eductor 2 motive fluid. Valve 11 is placed in the water line and closed to prevent tank fluid from backing up through water pump 7. Contained within tank 6 is a horizontal paddle arrangement 12 which is rotated by chain sprocket 13 hydraulic motor 14 and which is powered by hydraulic pump 15, via lines **15*a* and 15*b***.

A pneumatic delivery cement line (not shown) from transport truck is connected to cyclone inlet line 16 or 19. Carrier air is separated by the action of the cyclone separator 1 and exits through vent line 17. Dust contained in the carrier air is removed in washing chamber 20 with wash water incorporated into the slurry in tank 6. Valve 21 is closed when all the cement and water to be mixed in a specific batch of slurry has passed through mixing eductor 2. Valve 22 is used when needed to regulate the flow of dry cement from air separator 1 during mixing. Flow meter 23 is used to monitor the water rate into jet **2*a* during mixing and to measure the total volume of water incorporated into a specific batch of slurry. Valve 24 is opened to load slurry into spread truck through line 25 to an opening (not shown) in the tank 32*a* of truck 32. Valve 26 is closed to stop flow through recirculation line 9 during truck loading. Spray heads 27 are used to clean residual slurry from the tank walls and dust chamber 20 after slurry mixing is completed and tank is unloaded. Valves 28 and 29 control the use of cleaning water to spray heads 27**, from water line C.

Even when carrier air is separated, the dry cement entering the suction area of eductor 2, suction is still 50 to 55% air by volume. With dispersants which have a tendency to foam, tank fluid during the early stages of mixing can contain excessive air which can cause circulating pump 5 to lose efficiency. To prevent this, deflector 36 is added inside the tank 6 to the eductor discharge. This prevents air entrained fluid from being carried directly across the bottom of the tank to the pump suction outlet and provides better opportunity for foam and entrained air to float and not be drawn into the pump suction. A feature of the recirculation jet 3 and jet nozzle **3*a* is the distance the nozzle extends into the eductor discharge pipe 36 and 36.1. The nozzle stem 3.3 is threaded to engage nozzle holder 3.1 and be locked in position by nut 3.2, and is adjustable to obtain the optimum balance between circulation rate and mixing eductor throughput. An additional purpose of the by-pass jet 3 is to prevent back flow of slurry into the eductor and air separator 1 when motive fluid is stopped and before valve 21** can be closed at the end of mixing or change over from water to slurry as motive fluid during mixing.

Figure 4:
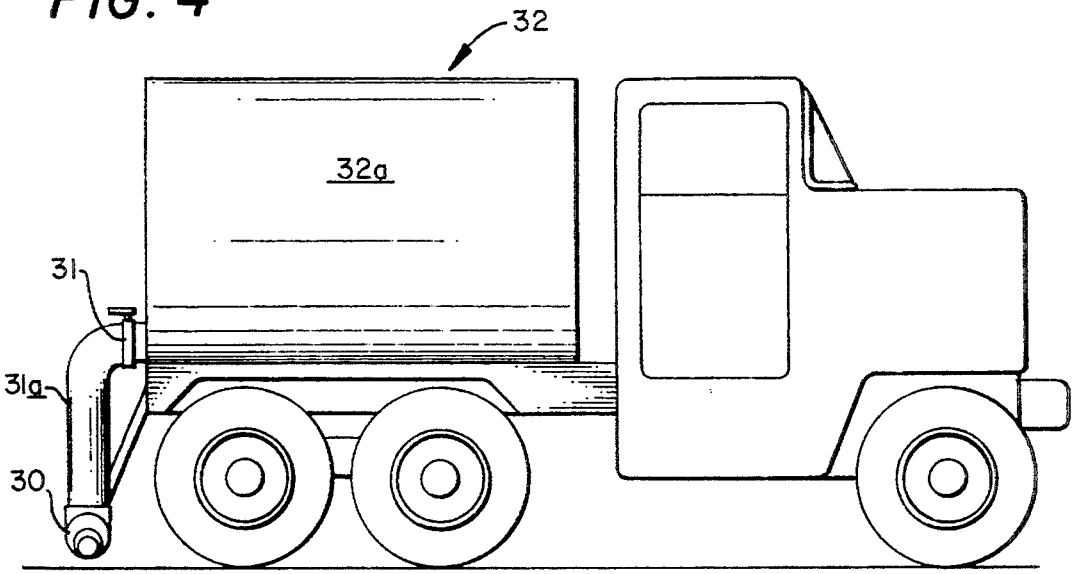
FIG. 4 shows the side view of a typical slurry spreader truck.
Figure 5:
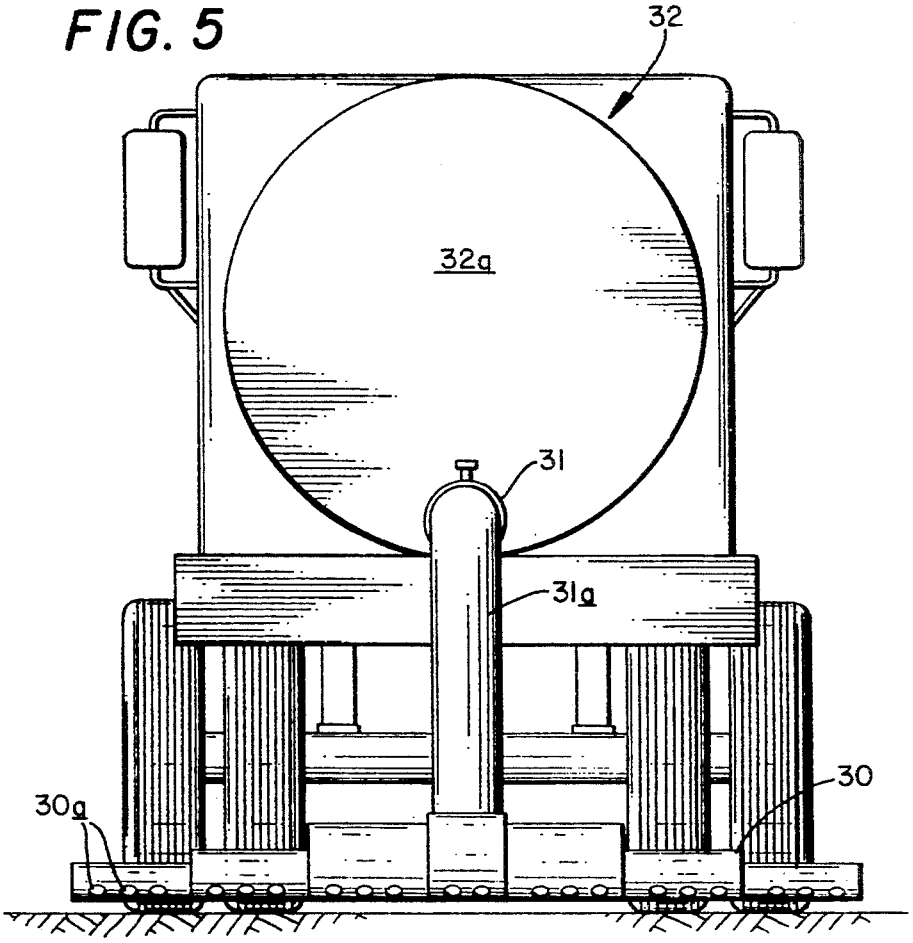
FIG. 5 shows detail for the slurry spread or spray bar as viewed from the back of the spread truck.
Figure 6:
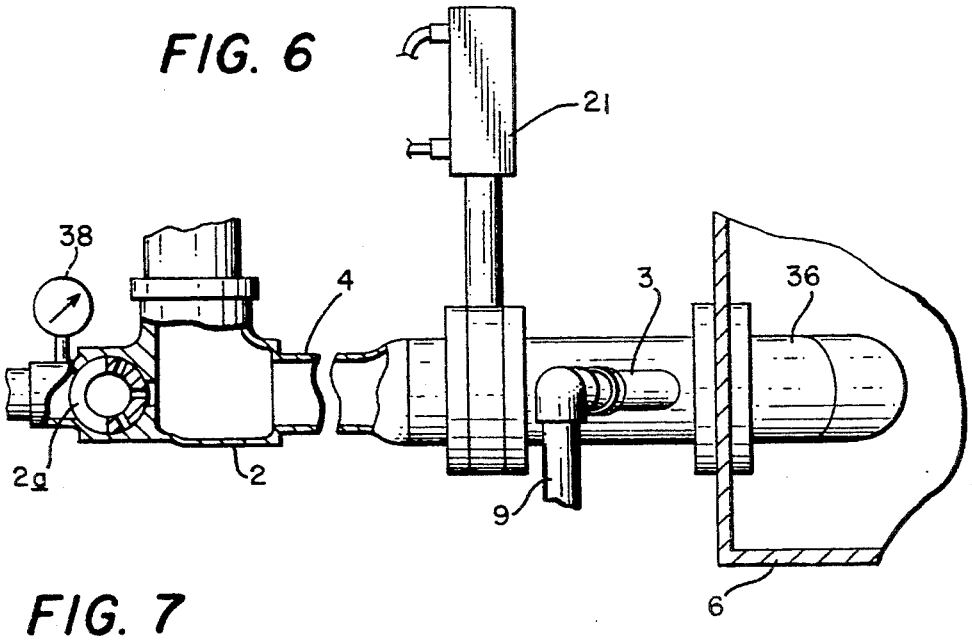
FIG. 6 is an enlarged side view, partly in section, showing the mixing eductor in relation to the by-pass jet.
Figure 7:
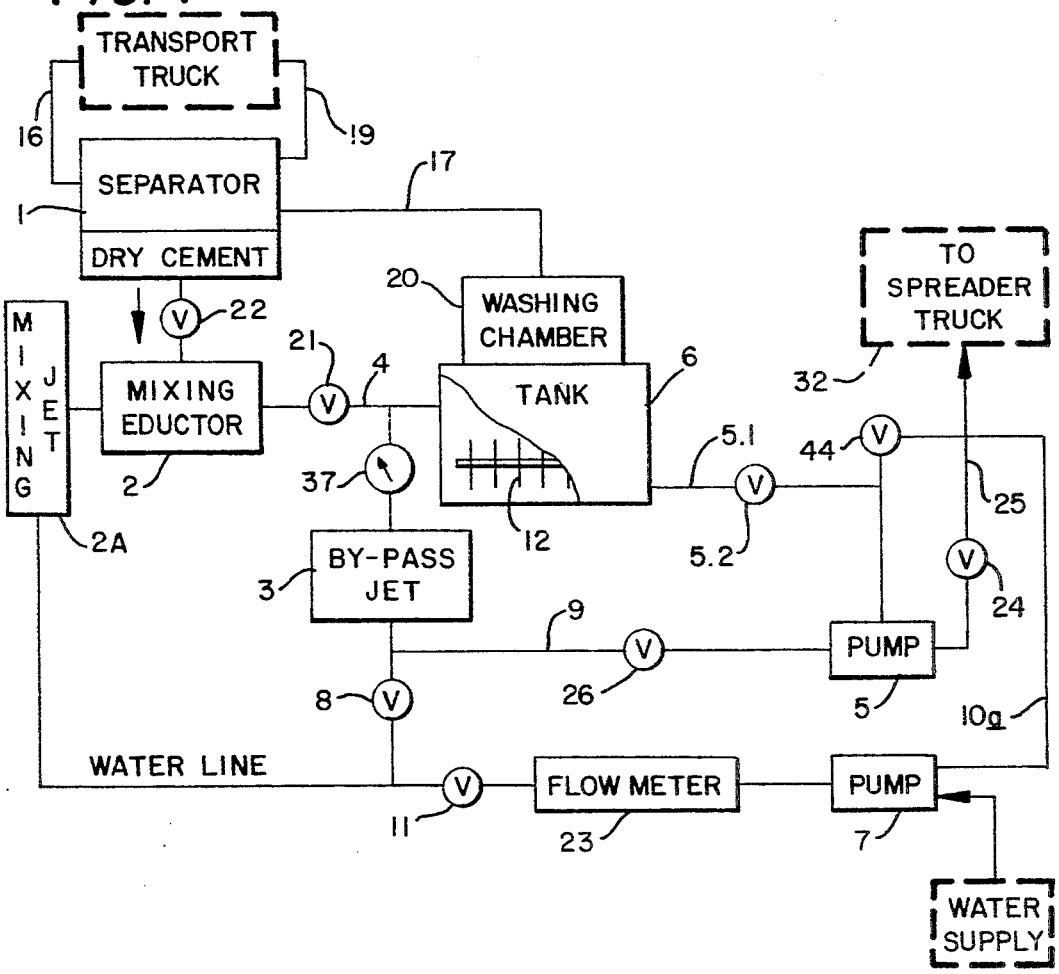
FIG. 7 is a schematic diagram showing the system of this invention.

After a batch of slurry has been mixed, spread trucks such as shown in FIGS. 4 and 5 are loaded and used to spread the slurry across the surface of previously prepared base material in a uniform layer.

A feature of the spreader truck is the modified spray bar 30 which distributes the slurry flow uniformly along the length of the spray bar at known total flow rate. The flow rate being controlled by the amount of slurry remaining in the truck tank **32*a*, the degree of opening of shut off valve 31, the diameter of conduit 31*a*, the number of nozzles or holes 30*a* in the spray bar, and the size of these holes. Knowing the total flow rate and spray bar length, the amount of slurry per unit area can be controlled by the speed of the truck. In practice the slurry mixing sequence is: Pump a measured volume of water into the containment tank which is just sufficient to establish circulation with pump 5 through bypass jet 3 back into tank 6. Add dispersant needed for the total amount of cement to be mixed. Circulate tank fluid, and rotate paddle 12 until dispersant chemicals are dissolved and/or dispersed in the water. Connect dry cement delivery line to air separator inlet 16 or 19 and fill air separator to top sight-glass 33 with valve 22 closed. With valve 8 closed and valve 11 open, circulate tank fluid through jet 3 at specified pressure (usually 50 to 100 psi). Start pumping water through mixing eductor jet 2a at specified rate or pressure (typically 130 gal/min at 80 to 120 psi). Immediately after establishing pressure, open dry cement valve 22 at bottom of air separator. As level of dry cement drops, valve 18a and 18b are used if needed to keep the dry cement level at or below top sight glass 33. Additional sight glasses 33a and 34** are installed as needed. Mixing is continued until the total amount of cement needed is incorporated into the slurry.

If the water volume needed for the batch being mixed is used before the cement is mixed into the slurry, valve 8 and 11 are switched to route circulated tank fluid through mixing eductor 2 at the same time the orifice size selector at 2a is switched to a larger nozzle size to allow sufficient flow of slurry without an increase in pressure and to prevent abrasion of the water jet nozzle. If the required amount of cement is mixed before the needed water volume is used, the dry cement valve 22 closed and water injection continued until the correct volume of water is incorporated into the slurry. When all the cement and water have been added, motive fluid to eductor 2 is stopped by closing valves 11 and/or 8. All fluid being pumped is diverted through by-pass jet 3. This prevents back flow into the eductor 2 while valve 21 is being closed.

Pressure gauges 37 and 38 are utilized where required, and control panel 43 provides for the operation of air operated valves and 22. Motors 41 and 42 provide power for pumps 5 and 7. Water is supplied to pump 7 by line 40 from a source not shown. Water supply valve 44 provides fluid to tank pump 5. The entire structure of this system is supported thru frame 35 by retractable wheels 39.

Several possible combinations of pump eductor jet and air separation are useful with the mixing method and system of this invention.

1. Two pump system with one pump circulating tank fluid and the other pump used to pump water directly into the mixing eductor jet(s).
   a. With dry cement supplied through air separator to remove and vent carrier air from pneumatically conveyed cement.
   b. With dry cement supplied directly from pneumatic truck without air separation.

2. A single pump to circulate tank fluid with or without air separation from dry cement. In this case water for entire batch of slurry is first measured into the tank, the dispersant is added and the tank fluid is pumped through the mixing eductor as the motive fluid with or without a bypass.

3. The mixing eductor may contain a single jet, a number of jets, separate jets for recirculated tank fluid and water, and one or more bypass jets. The purpose of the bypass jet(s) are to allow a faster circulation rate to enhance slurry mixing and to reduce eductor discharge pressure.

After mixing is completed regardless of specific mixer configuration used, the slurry is loaded onto spreader trucks and distributed as previously described onto the surface of previously prepared base material. The slurry is then mixed into the entire layer of base material typically using a machine having a rotating horizontal drum or shaft with blades, spikes or prongs attached. The mixed soil cement is then shaped, graded, compacted and finished to specified grade and plan. After finishing, the surface is kept damp for at least six hours or until covered with a layer of "curing" material.

An alternate method is to distribute the slurry by means of a spray bar (similar to that shown at 30) attached directly to the mixing machine whereby the slurry is sprayed onto the surface of the base material and immediately mixed into the total layer of base material. The slurry is supplied to the spray bar by a tank (not shown) attached to the mixing machine or on a trailer towed (not shown) by the mixing machine.

Still another method of distributing the slurry is via a spray bar attached to a long hose through which the slurry is pumped directly from the mixer tank or other centrally located tank. To spread the slurry uniformly, the spray bar is towed by a small tractor at a speed determined by the pumping rate an amount of slurry per unit area needed.

Regardless of the slurry distribution method, the freshly spread slurry is mixed into the total layer of base material without unnecessary delay and followed by shaping, grading and finishing as previously described.

The present invention improves on the conventional cement treated base construction procedure by completely eliminating the exposure of people, animals, and the environment to harmful cement dust by providing a means of using a water-cement slurry to accomplish the same or better results. In addition the method of this invention commonly produces finished cement treated base with less man-hours and equipment-use-hours.

The mixing method of the present invention differs from other commonly used mixing methods by:

a. Mixing slurry on location at a faster rate with a single mixing unit.

b. Produces a slurry that has a higher solids (cement) content and is still free-flowing and has sufficient hydration delay time to allow more efficient shaping, grading and compaction operations.

c. Produces a slurry with less variation from specified properties.

d. Allows a choice of slurry distribution or spreading method which eliminates the use of cumbersome mixing trucks for spreading the slurry as shown in applicant's previous invention, U.S. Pat. No. 5,064,292.

A tabulation of the reference numbers used in this Specification and in the Drawing appears hereafter to facilitate ready identification:

KEY TO REFERENCE NOS.

| REF # | Description of Part(s) |
|---|---|
| 1 | Cyclone air separator |
| 2 | Mixing eductor |
| 2a | Adjustable orifice jet ring |
| 3 | By-pass circulation jet |
| 3a | Jet nozzle |
| 3.1 | Nozzle holder |
| 3.2 | Lock nut |
| 3.3 | Nozzle stem |
| 4 | Eductor discharge line |
| 5 | Tank circulation pump |
| 5.1 | Suction line from tank to pump 5 |
| 6 | Slurry holding or containment tank |
| 7 | Water pump |
| 8 | Water line isolation valve |
| 9 | Tank fluid circulation line |
| 10 | Water line to mixing eductor |
| 11 | Water line shutoff valve |

-continued

KEY TO REFERENCE NOS.

| REF # | Description of Part(s) |
|---|---|
| 12 | Horizontal paddle structure assembly |
| 13 | Chair sprocket drive |
| 14 | Hydraulic motor, paddle drive |
| 15 | Pump and controls for hydraulic drive for paddle |
| 16 | Dry cement inlet line for first inlet |
| 17 | Air vent line from air separator |
| 18a & b | Dry cement inlet valves (two locations) |
| 19 | Dry cement inlet line for second inlet |
| 20 | Spray chamber to remove dust from air |
| 21 | Eductor exit shutoff valve, air operated |
| 22 | Dry cement control valve, air operated |
| 23 | Flow meter to measure rate and volume |
| 24 | Truck loading shutoff valve |
| 25 | Truck loading line |
| 26 | Circulation line shutoff valve |
| 27 | Spray heads for tank cleaning |
| 28 | Water valve to dust spray chamber 20 |
| 29 | Water valve to tank cleaning spray heads |
| 30 | Spreader truck spray bar |
| 31 | Shutoff valve to truck spray bar |
| 31a | Cement conduit |
| 32 | Spreader truck |
| 33 | Sight glass |
| 34 | Bottom sight glass |
| 35 | Support frame |
| 36 | Deflector el |
| 36.1 | Extension nipple to increase pumping action of bypass jet 3 |
| 37 | By-pass jet pressure gauge |
| 38 | Motive fluid (eductor jet) pressure gauge |
| 39 | Retractable wheels |
| 40 | Hose to water source |
| 41 | Motor for pump 5 |
| 42 | Motor for pump 7 |
| 43 | Control panel; throttles for pump motors and control valves for operation of valves 21, 22 |
| 44 | Water supply valve for tank circulation pump 5 |

Modification and variations of this invention are possible in light of the above teachings. It is, therefore, understood that within the spirit and scope of the appended claims, the invention may be practiced otherwise than as specifically described, and/or by using equivalents.

What is claimed is:

1. A method of rapid mixing of high solids water cement slurry which is free flowing, highly dispersed, and has an extended and controlled hydration onset period, using such slurry for preparing soil-cement for construction of a base layer for building either roadways, parking lots, taxi ways, runways, aprons, land fill containment bases, or dikes; comprising the combination method:

wherein the cement content of said soil-cement is taken from at least one of the categories of Portland, self-setting Class C fly ash, and cement blends of fly ash, ground slag, calcined shale, and lime fly ash, and wherein the slurry after having carrier air removed from the incoming cement and having a controlled amount of water added, is thoroughly mixed in an on-site portable mixing system placed at the construction site, which is stationary when in use and including a batch tank, and adding chemical hydration retarder, and circulating said slag through mixing jets in a mixing system and incorporated into soil cement by spreading or spraying prepared slurry onto a surface of a layer of previously prepared base material at a job-site, and by mixing with a traveling mixer into the base material, which in turn is followed by shaping, compacting and grading of the soil-cement to specified grade and plan, and wherein dry powdered cement is mixed with fluid which may be mixing water or formulated slurry from the containment tank, or a combination of both; and wherein water and recirculated tank fluid are pumped through separate openings; and where the mixing water passes through a motive fluid nozzle in an eductor; and where all or part of the recirculated tank fluid is pumped through a by-pass jet containing a ventura throat is placed in line connecting the eductor discharge to the containment tank and wherein the distance between the motive fluid nozzle and ventura throat is adjustable.

* * * * *